US010984998B2

(12) United States Patent
Midorikawa

(10) Patent No.: US 10,984,998 B2
(45) Date of Patent: Apr. 20, 2021

(54) MASS SPECTROMETER

(71) Applicant: SHIMADZU CORPORATION, Kyoto (JP)

(72) Inventor: Yusuke Midorikawa, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/754,978

(22) PCT Filed: Oct. 26, 2017

(86) PCT No.: PCT/JP2017/038774
§ 371 (c)(1),
(2) Date: Apr. 9, 2020

(87) PCT Pub. No.: WO2019/082351
PCT Pub. Date: May 2, 2019

(65) Prior Publication Data

US 2020/0303174 A1 Sep. 24, 2020

(51) Int. Cl.
*H01J 49/02* (2006.01)
*H01J 49/00* (2006.01)
(Continued)

(52) U.S. Cl.
CPC ..... *H01J 49/022* (2013.01); *H01J 49/005* (2013.01); *H01J 49/0095* (2013.01);
(Continued)

(58) Field of Classification Search
CPC ..... H01J 49/022; H01J 49/005; H01J 49/401; H01J 49/4215; H01J 49/067; H01J 49/0095
(Continued)

(56) References Cited

U.S. PATENT DOCUMENTS

2006/0038121 A1* 2/2006 Guevremont ..... G01N 27/624 250/290
2010/0288922 A1 11/2010 Itoi et al.
(Continued)

FOREIGN PATENT DOCUMENTS

EP 2 187 204 A 5/2010
JP 2012-94543 A 5/2012
(Continued)

OTHER PUBLICATIONS

Written Opinion for PCT/JP2017/038774, dated Jan. 9, 2018.
International Search Report for PCT/JP2017/038774, dated Jan. 9, 2018.

*Primary Examiner* — Kiet T Nguyen
(74) *Attorney, Agent, or Firm* — Sughrue Mion, PLLC

(57) ABSTRACT

In a tandem mass spectrometer, when the measurement mode is switched between a positive ion measurement mode and a negative ion measurement mode, a DC offset voltage applied to a lens electrode to impart collision energy to an ion is temporarily switched to 0V (S1). After being maintained at 0V for a predetermined waiting time (S2), the voltage is changed to a DC offset voltage corresponding to a measurement mode which is used after the switching operation (S3). By such an operation, the voltage difference between the neighboring plate electrodes among the plate electrodes (171, 172, 173) included in the lens electrode can be decreased as compared to the case where the polarity of the DC offset voltage is immediately switched. Consequently, unintended electric discharge between the neighboring electrodes can be prevented.

6 Claims, 3 Drawing Sheets

(51) Int. Cl.
*H01J 49/40* (2006.01)
*H01J 49/42* (2006.01)
*H01J 49/06* (2006.01)

(52) U.S. Cl.
CPC ..... *H01J 49/067* (2013.01); *H01J 49/401* (2013.01); *H01J 49/4215* (2013.01)

(58) Field of Classification Search
USPC ..... 250/287, 281
See application file for complete search history.

(56) References Cited

U.S. PATENT DOCUMENTS

| | | | |
|---|---|---|---|
| 2013/0214148 | A1 | 8/2013 | Albeanu et al. |
| 2015/0287580 | A1 | 10/2015 | Mizutani |
| 2017/0271140 | A1 | 9/2017 | Okumura |

FOREIGN PATENT DOCUMENTS

| | | | |
|---|---|---|---|
| JP | 5822031 | B2 | 11/2015 |
| JP | 5914461 | B2 | 5/2016 |
| WO | 2008/136040 | A1 | 11/2008 |
| WO | 2009/037725 | A1 | 3/2009 |
| WO | 2016/027833 | A1 | 2/2016 |
| WO | 2017/145380 | A1 | 8/2017 |

* cited by examiner

MASS SPECTROMETER

CROSS REFERENCE TO RELATED APPLICATIONS

This application is a National Stage of International Application No. PCT/JP2017/038774 filed Oct. 26, 2017.

TECHNICAL FIELD

The present invention relates to a mass spectrometer, and more specifically, to a mass spectrometer having a collision cell configured to dissociate an ion by collision induced dissociation (CID).

BACKGROUND ART

A triple quadrupole mass spectrometer and quadrupole time-of-flight mass spectrometer are commonly known types of devices in which an ion originating from a compound in a sample is dissociated by collision induced dissociation, and the thereby generated product ions are subjected to mass spectrometry. A triple quadrupole mass spectrometer includes a collision cell configured to dissociate an ion, with two quadrupole mass filters serving as mass analyzers located on the front and rear sides of the collision cell, respectively. A quadrupole time-of-flight mass spectrometer includes a quadrupole mass filter and orthogonal acceleration time-of-flight mass analyzer located on the front and rear sides of the collision cell, respectively (see Patent Literature 1 or other related documents). These types of devices are hereinafter collectively called the tandem mass spectrometer.

In a tandem mass spectrometer, an inert gas (e.g. argon) is introduced into the collision cell. An ion having a high amount of energy is introduced into the collision cell and is made to undergo dissociation through collision with the inert gas. For an efficient dissociation of the ion, it is necessary to impart at least a certain amount of energy (collision energy) to the ion when introducing the ion into the collision cell. This collision energy is given to the ion by a voltage difference between a DC voltage applied to an ion guide placed within the collision cell or to an entrance-end electrode or exit-end electrode of the collision cell, and a DC voltage applied to a lens electrode, ion guide or similar ion optical element located at a frontward or rearward position from the collision cell (as viewed along the flow of ions).

In the case of a triple quadrupole mass spectrometer, the collision energy may also be imparted to the ion by applying a predetermined DC offset voltage to the ion optical element located at the rearward position from the collision cell in addition to a voltage applied for the intended purpose, such as the converging of the ions. On the other hand, in the case of a quadrupole time-of-flight mass spectrometer, the collision energy is often imparted by applying a DC offset voltage to the ion optical element located at a frontward position from the collision cell in addition to the voltage applied for the intended purpose. The main reason for this configuration is to improve the mass accuracy in the time-of-flight mass analyzer by preventing the DC offset voltage for imparting collision energy to the ion from affecting the electric field in the orthogonal accelerator section of the time-of-flight mass analyzer located in the subsequent stage.

A mass spectrometer is normally configured to allow for a selective execution of a positive ion measurement mode for the measurement of a positive ion and a negative ion measurement mode for the measurement of a negative ion.

Using the positive ion measurement mode and negative ion measurement mode requires switching the polarity of the voltages applied to the ion source, ion optical elements and other related sections. In this operation, the polarity of the aforementioned DC offset voltage for imparting collision energy to the ion is also switched. Conventional tandem mass spectrometers have a problem with this operation as follows.

FIG. 5 is a schematic configuration diagram of a section near the ion entrance opening of the collision cell in a conventional tandem mass spectrometer.

The collision cell 19 contains a multipole ion guide 18. A lens electrode 17 formed by a plurality of (in the present example, three) plate electrodes 171, 172 and 173 is placed between the collision cell 19 and a quadrupole mass filter (not shown) located at a frontward position from the collision cell 19. The collision cell 19 has an entrance-end electrode 191 on its ion entrance end face. This electrode has an ion entrance opening 191*a* at its center. DC voltages V1, V2 and V3 generated by adding different ion-converging DC voltages to a common DC offset voltage so as to make the ions coming from the left side converge onto an area near the ion entrance opening 191*a* are applied to the three plate electrodes 171-173 forming the lens electrode 17, respectively. Meanwhile, voltage V5 generated by adding a radio-frequency voltage for converging ions to a DC bias voltage having a predetermined potential difference from the aforementioned DC offset voltage is applied to the ion guide 18. Additionally, DC bias voltage V4 is applied to the entrance-end electrode 191. For example, this voltage may be the same as the one applied to the ion guide 18.

Due to the voltage difference between the DC offset voltage applied to the lens electrode 17 (as well as the ion guide and other ion optical elements located at a further frontward position from the lens electrode 17) and the DC bias voltage applied to the entrance-end electrode 191 and the ion guide 18, the ion is accelerated, or given a predetermined amount of collision energy, and enters the collision cell 19. Within the collision cell 19, the ion collides with the inert gas and undergoes dissociation. The larger the voltage difference is, the higher the amount of collision energy becomes, making the ion powerfully collide with the inert gas.

The ion-converging DC voltages applied to the plate electrodes 171-173 forming the lens electrode 17 need to be different from each other. Furthermore, those voltages need to be individually adjusted according to the mass-to-charge ratio of the ion which is the measurement target. Therefore, a separate voltage source (voltage generation circuit) for applying a voltage to a plate electrode must be prepared for each of the plate electrodes 171-173. As noted earlier, the polarity of the DC offset voltage is also changed when the measurement mode is switched between the positive ion measurement mode and the negative ion measurement mode. It is difficult to switch the DC offset voltages in those separate voltage sources at exactly the same timing. A slight discrepancy in timing inevitably occurs. Normally, the value of the DC offset voltage is variable. Consider the example in which the DC offset voltage is ±200V. If a slight discrepancy in timing of the switching of the polarity is present as described earlier, a large voltage difference of 400V occurs between closely located plate electrodes, although its duration is rather short. If the gap between the neighboring plate electrodes is narrow, the voltage difference may cause electric discharge between the plate electrodes, which possibly causes the plate electrodes to be damaged or at least contaminated even if not damaged.

Such a problem is not limited to the lens electrode located immediately in front of the collision cell 19. A similar problem can also occur with other ion optical elements to which a comparatively high amount of DC offset voltage is applied in order to impart collision energy to the ion.

CITATION LIST

Patent Literature

Patent Literature 1: JP WO 2016/027833 A
Patent Literature 2: WO 2008/136040 A

SUMMARY OF INVENTION

Technical Problem

The present invention has been developed to solve the previously described problem. Its objective is to provide a mass spectrometer which can prevent unintended electric discharge between the closely located electrodes in the switching operation of the positive and negative ionization modes.

Solution to Problem

The present invention developed for solving the previously described problem is a mass spectrometer capable of an MS/MS measurement, including a collision cell configured to dissociate an ion by collision induced dissociation, and a plurality of electrodes located at a frontward or rearward position from the collision cell and configured to be supplied with a DC offset voltage for imparting collision energy to an ion entering the collision cell, the mass spectrometer further including:

a) a plurality of voltage generators configured to apply voltages to the plurality of electrodes, respectively; and b) a voltage controller configured to control the plurality of voltage generators in switching the polarity of the DC offset voltage along with a switching operation between a positive ion measurement mode and a negative ion measurement mode, in such a manner that each of the voltages applied to the plurality of electrodes is temporarily changed to zero from a DC offset voltage used immediately before the switching operation, then maintained at zero for a predetermined waiting time, and subsequently changed to a DC offset voltage to be used after the switching operation.

For example, the present invention may be a triple quadrupole mass spectrometer or quadrupole time-of-flight mass spectrometer. Examples of the "plurality of electrodes located at a frontward or rearward position from the collision cell" in the present invention include: a lens electrode located between the collision cell and a quadrupole mass filter or similar mass analyzer located at a frontward position from the collision cell; a lens electrode located between the collision cell and a time-of-flight mass analyzer, quadrupole mass filter or similar mass analyzer located at a rearward position from the collision cell; and a lens electrode located at a further frontward position from a quadrupole mass filter or similar mass analyzer located at a frontward position from the collision cell.

The voltage controller in the present invention controls the plurality of voltage generators in an MS/MS measurement in the positive ion measurement mode or negative ion measurement mode so as to apply, to the plurality of electrodes, a DC offset voltage whose polarity depends on that of the ion which is the measurement target. When a command to switch the measurement mode from the positive ion measurement mode to the negative ion measurement mode, or conversely, from the negative ion measurement mode to the positive ion measurement mode, has been issued, for example, from a main controller responsible for controlling the operation of the entire system, the voltage controller controls the plurality of voltage generators so as to initially change the DC offset voltage to zero rather than directly changing the voltage to the DC offset voltage to be used after the switching operation. Subsequently, the voltage controller controls the plurality of voltage generators so as to maintain the DC offset voltage at zero for a predetermined period of waiting time, and then change the voltage to the DC offset voltage to be used after the switching operation.

When a command signal is sent to the plurality of voltage generators to simultaneously switch their respective voltages, a slight discrepancy in timing of the voltage change occurs between the voltages applied to those electrodes due to the delay of the command signal, variation in the characteristics of the circuit elements in the voltage generators or other factors. The waiting time is set to be longer than the largest expected value of the time discrepancy. As a result, for example, when the DC offset voltages used before and after the switching operation are +Voffset and −Voffset, respectively, the difference between the DC offset voltages applied to two closely located electrodes among the plurality of electrodes will not exceed Voffset. That is to say, the voltage difference is decreased to one half of 2×Voffset, i.e. the largest voltage difference which occurs if the voltage-switching operation is performed without the waiting time.

If the waiting time is excessively short, the timing discrepancy of the voltage change may exceed the waiting time and cause a significant difference in voltage between the two closely located electrodes. Conversely, if the waiting time is unnecessarily long, a considerable amount of time will be required for the switching operation between the positive ion measurement mode and the negative ion measurement mode. The timing discrepancy of the voltage change between the voltages applied to the plurality of electrodes in the previously described voltage-switching operation depends on the circuit configuration of the voltage generators and other device-specific factors as well as on the values of those voltages.

Accordingly, it is preferable for the present invention to further include a time setter configured to allow a user to set the waiting time. This configuration allows a user to set an appropriate waiting time so as to assuredly decrease the voltage difference between the closely located electrodes without taking an unnecessary period of time for the switching operation between the positive and negative ion measurement modes.

Advantageous Effects of Invention

The mass spectrometer according to the present invention can prevent unintended electric discharge between the closely located electrodes in the switching operation between the positive and negative ionization modes. Therefore, an occurrence of damage to or contamination of the electrodes due to such electric discharge can be avoided.

DESCRIPTION OF EMBODIMENTS

A quadrupole time-of-flight ("Q-TOF") mass spectrometer as one embodiment of the present invention is hereinafter described with reference to the attached drawings.

Figure 1:
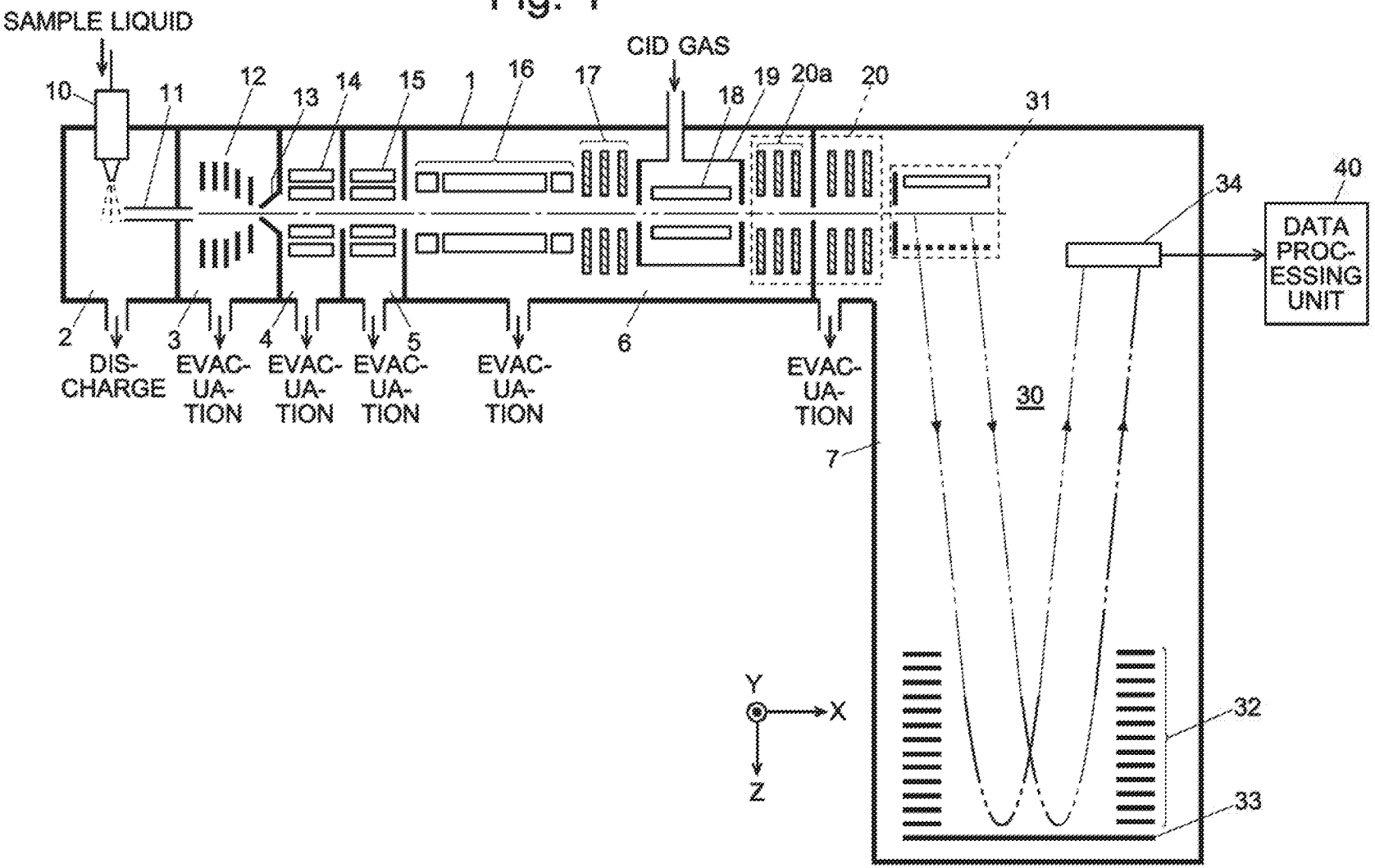
FIG. 1 is a schematic configuration diagram of a Q-TOF mass spectrometer as one embodiment of the present invention.

FIG. 1 is a schematic configuration diagram of the Q-TOF mass spectrometer according to the present embodiment.

The Q-TOF mass spectrometer according to the present embodiment has the configuration of a multi-stage differential pumping system including a chamber 1, within which first through third intermediate vacuum chambers 3, 4 and 5 are provided between an ionization chamber 2 maintained at substantially atmospheric pressure and a first analysis chamber 6 maintained at a high degree of vacuum. A second analysis chamber 7 maintained at an even higher degree of vacuum is also provided in a stage subsequent to the first analysis chamber 6.

The ionization chamber 2 is provided with an ESI spray 10 for electrospray ionization (ESI). When a sample liquid containing a target compound is supplied to the ESI spray 10, the liquid is given imbalanced electric charges from the tip of the spray 10 and sprayed in the form of droplets, from which ions originating from the target compound are generated. It should be noted that the ionization method is not limited to this procedure.

The various ions generated in the ionization chamber 2 are sent into the first intermediate vacuum chamber 3 through a heated capillary 11. The ions are subsequently converged by an ion guide 12 and sent into the second intermediate vacuum chamber 4 through a skimmer 13. The ion guide 12 in the present embodiment is a device called the "Q array" formed by a plurality of plate electrodes (see Patent Literature 2 or other related documents), although the type of ion guide 12 is not limited to this example. The ions are further converged by multipole ion guides 14 and 15, as well as sent through the second intermediate vacuum chamber 4 and the third intermediate vacuum chamber 5 into the first analysis chamber 6. The first analysis chamber 6 contains a quadrupole mass filter 16, a lens electrode 17 including a plurality of plate electrodes, and a collision cell 19 containing a quadrupole ion guide 18.

Figure 5:
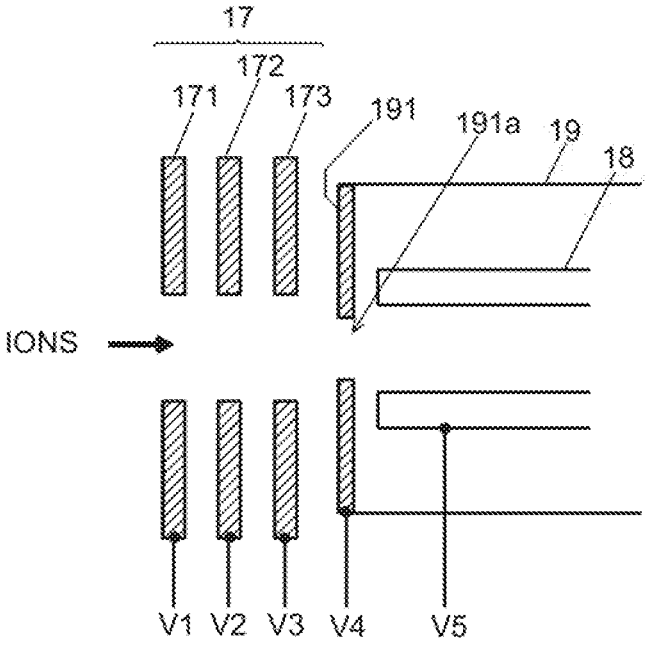
FIG. 5 is a schematic configuration diagram of a section near the ion entrance opening of the collision cell in a conventional tandem mass spectrometer.

The various ions derived from a sample are introduced into the quadrupole mass filter 16. When an MS/MS measurement is performed, only an ion having a specific mass-to-charge ratio corresponding to the voltage applied to the quadrupole mass filter 16 is allowed to pass through the quadrupole mass filter 16. This ion travels through the lens electrode 17 and is introduced into the collision cell 19 as the precursor ion. The precursor ion collides with the collision gas supplied from an outside source into the collision cell 19, whereby various product ions are generated. The lens electrode 17, which is an electrostatic lens formed by a plurality of plate electrodes 171-173 as shown in FIG. 5, is configured to converge ions by a DC electric field created by DC voltages applied to the plate electrodes 171-173.

The product ions generated by dissociation exit from the collision cell 19 and are introduced into the second analysis chamber 7, being guided by the ion transport optical system 20 which is an electrostatic lens. The second analysis chamber 7 contains an orthogonal accelerator section 31 which is the ion ejection source, a flight space 30 having a reflector 32 and back plate 33, as well as an ion detector 34. The ions introduced into the orthogonal accelerator section 31 in the X-axis direction begin are accelerated in the Z-axis direction at a predetermined timing and begin to fly. The accelerated ions initially fly freely. After being returned by a reflective electric field created by the reflector 32 and back plate 33, the ions once more fly freely and arrive at the ion detector 34. The time of flight from the point in time where an ion departs from the orthogonal accelerator section 31 to the point in time where the ion arrives at the ion detector 34 depends on the mass-to-charge ratio of the ion. A data processing unit 40 receives detection signals from the ion detector 34, creates a time-of-flight spectrum based on the detection signals, and determines a mass spectrum by converting the time of flight into mass-to-charge ratio.

When a measurement is performed in this Q-TOF mass spectrometer, predetermined voltages are respectively applied to the electrodes. To this end, voltage sources for generating voltages to be respectively applied to the electrodes are provided. The ion to be subjected to the measurement may be a positive ion or negative ion. The user selects which of the positive and negative measurement modes should be used for the measurement. Switching the measurement mode between the positive and negative ion measurement modes requires inverting the polarity of the voltages applied to the electrodes. The Q-TOF mass spectrometer according to the present embodiment performs a characteristic control in switching the measurement mode. This point is hereinafter described in detail.

Figure 2:
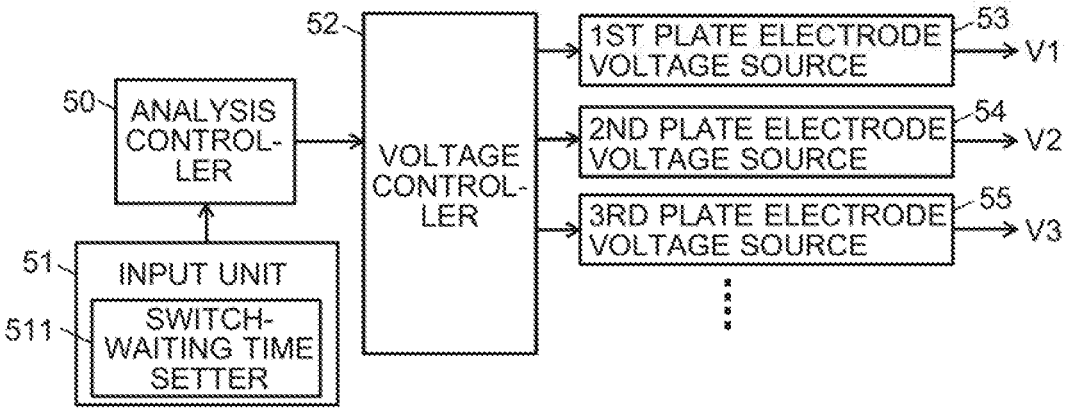
FIG. 2 is a configuration diagram of the control system for a portion of the Q-TOF mass spectrometer according to the present embodiment.
Figure 3:
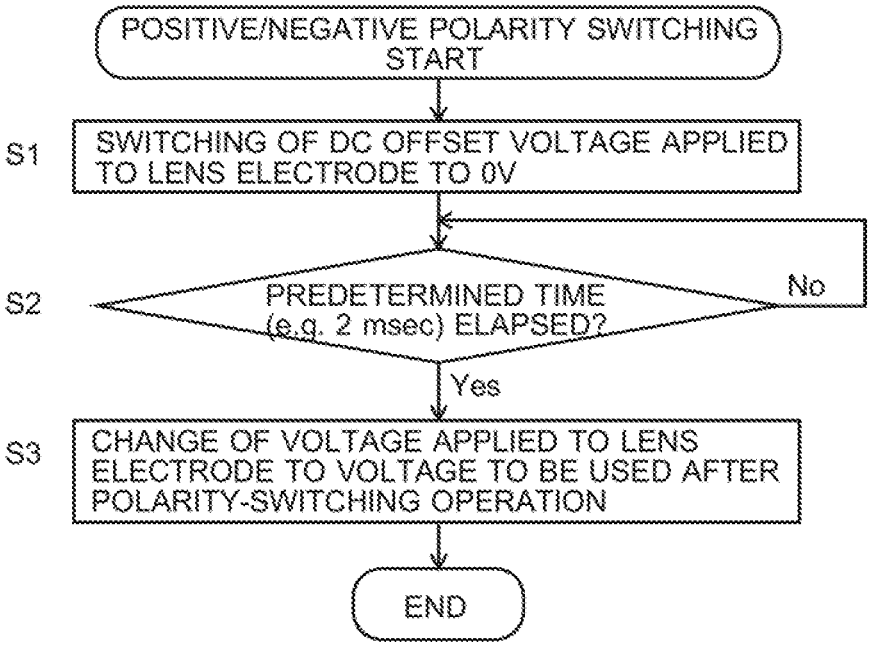
FIG. 3 is a flowchart of the voltage-polarity switching procedure for the switching operation between the positive ion measurement mode and the negative ion measurement mode in the Q-TOF mass spectrometer according to the present embodiment.
Figure 4:
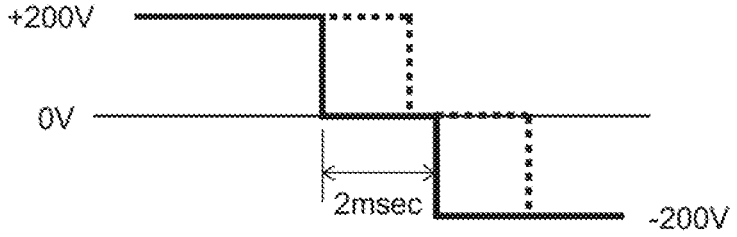
FIG. 4 is a diagram showing one example of the waveform of the DC offset voltage for the switching operation from the positive ion measurement mode to the negative ion measurement mode in the Q-TOF mass spectrometer according to the present embodiment.

FIG. 2 is a configuration diagram of the control system for the main components of the Q-TOF mass spectrometer according to the present embodiment. FIG. 3 is a flowchart of the voltage-polarity switching procedure for the switching operation between the positive ion measurement mode and the negative ion measurement mode. FIG. 4 is a diagram showing one example of the waveform of the offset voltage for the switching operation from the positive ion measurement mode to the negative ion measurement mode.

In FIG. 2, the analysis controller 50 is responsible for the general control of the entire system. The voltage controller 52 operates under the control of the analysis controller 50 to control the voltage sources for generating voltages to be applied to the relevant sections. The present system includes a considerable number of voltage sources, of which FIG. 2 shows only the first plate electrode voltage source 53, second plate electrode voltage source 54 and third plate electrode voltage source 55 which respectively apply predetermined voltages to the plate electrodes 171-173 included in the lens electrode 17. An input unit 51 for user operation is connected to the analysis controller 50. The input unit 51 includes a switch-waiting time setter 511 configured to allow users to set the switch-waiting time, which is one of the analysis conditions.

In order to converge ions which have passed through the quadrupole mass filter 16 into the ion entrance opening 191*a* of the collision cell 19 and make the ions efficiently pass through, predetermined ion-converging DC voltages are applied to the three plate electrodes 171-173 in the lens electrode 17, respectively. Furthermore, a DC offset voltage having a voltage value corresponding to the amount of collision energy to be imparted to the ion entering the collision cell 19 (precursor ion) is additionally applied to the three plate electrodes 171-173.

As one example, consider the case where the DC bias voltage applied to the ion guide 18 within the collision cell 19 is 0 V, and the DC offset voltage is ±200V. If the measurement mode is the positive ion measurement mode, the voltage controller 52 controls the first through third plate electrode voltage sources 53-55 so as to apply a DC offset voltage of +200V to each of the plate electrodes 171-173 forming the lens electrode 17. As a result, an electric field is created which imparts a predetermined amount of collision energy to a positive ion passing through the quadrupole mass filter 16 to introduce the ion into the collision cell 19.

When a command to switch the measurement mode from the positive ion measurement mode to the negative ion measurement mode is sent from the analysis controller 50 to the voltage controller 52, the voltage controller 52 initially controls the first through third plate electrode voltage sources 53-55 so that the DC offset voltage applied to the plate electrodes 171-173 forming the lens electrode 17 is temporarily switched from +200V to 0V (Step S1). As a result, the DC offset voltage applied to the plate electrodes 171-173 changes from +200V to 0V, as indicated by the thick line in FIG. 4.

The voltage controller 52 subsequently maintains the previously described state until the waiting time previously set by an internal timer is elapsed (Step S2). The waiting time is a period of time which is previously set by the user through the switch-waiting time setter 511 or specified by default. For example, this value is hereinafter assumed to be 2 msec. After the lapse of the waiting time ("Yes" in Step S2), the voltage controller 52 controls the first through third plate electrode voltage sources 53-55 so that the DC offset voltage applied to the plate electrodes 171-173 is switched to −200V which corresponds to the negative ion measurement mode (Step S3). By such an operation, the DC offset voltage applied to the plate electrodes 171-173 is maintained at 0V for 2 msec and then changes from 0V to −200V, as indicated by the thick line in FIG. 4.

The switching operation from the negative ion measurement mode to the positive ion measurement mode is also performed in a similar manner: The DC offset voltage applied to the plate electrodes 171-173 is temporarily switched from −200V to 0V. After being maintained at 0V for 2 msec, the voltage is switched from 0V to +200V. Thus, in the Q-TOF mass spectrometer according to the present embodiment, when the measurement mode is switched between the positive and negative ion measurement modes, the DC offset voltage is temporarily switched to 0V and maintained at 0V for the previously set waiting time before the voltage is ultimately switched to the DC offset voltage corresponding to the measurement mode to be used after the switching operation.

The voltage controller 52 sends a signal to the first through third plate electrode voltage sources 53-55 to simultaneously switch the voltage. However, a discrepancy may occur in the timing of the change in the voltage actually applied from the voltage sources 53-55 to the plate electrodes 171-173. This timing discrepancy mainly results from such factors as the variation in characteristics of the elements forming the circuits in the voltage sources or the difference in the amount of delay of the signals due to a difference in wiring length. The user should set a waiting time that is longer than the expected timing discrepancy.

The waveform shown by the broken line in FIG. 4 is a waveform in the case where there is approximately 1.5 msec of timing discrepancy. If this timing discrepancy does not exceed the waiting time, there is no possibility that the DC offset voltage applied to one plate electrode is changed to −200V while the DC offset voltage applied to another plate electrode is still at +200V. That is to say, the voltage difference between the neighboring plate electrodes is limited to 200V and cannot be 400V. By restricting the voltage difference which occurs between the neighboring plate electrodes in this manner, the electric discharge between those electrodes can be prevented.

Although the description so far has been concerned with only the voltages applied to the plate electrodes 171-173 forming the lens electrode 17, the same description is similarly applicable in the case of applying a DC offset voltage to the plate electrodes forming the ion guide 12 which is a Q array, for example.

If the collision energy is considerably low, the DC offset voltage also becomes low. If the DC offset voltage is lowered to a certain extent, no electric discharge will occur even if a voltage difference which equals two times the DC offset voltage occurs between the neighboring electrodes. Accordingly, when the DC offset voltage is equal to or less than a predetermined value, the processing as shown in FIG. 3 may be omitted, and the polarity of the DC offset voltage may be immediately switched. This shortens the period of time for the switching operation between the positive and negative ion measurement modes.

The previously described embodiment is concerned with the case of applying the present invention in a Q-TOF mass spectrometer. Understandably, the present invention is also applicable in a triple quadrupole mass spectrometer.

Furthermore, it is evident that the previously described embodiment is a mere example of the present invention, and any change, modification, addition or the like appropriately made within the spirit of the present invention will fall within the scope of claims of the present application.

REFERENCE SIGNS LIST

1 . . . Chamber
2 . . . Ionization Chamber
3 . . . First Intermediate Vacuum Chamber
4 . . . Second Intermediate Vacuum Chamber
5 . . . Third Intermediate Vacuum Chamber
6 . . . First Analysis Chamber
7 . . . Second Analysis Chamber
10 . . . ESI Spray
11 . . . Heated Capillary
12 . . . Ion Guide
13 . . . Skimmer
14 . . . Ion Guide
16 . . . Quadrupole Mass Filter
17 . . . Lens Electrode
171, 172, 173 . . . Plate Electrode
18 . . . Ion Guide
19 . . . Collision Cell
20 . . . Ion Transport Optical System
30 . . . Flight Space
31 . . . Orthogonal Accelerator Section
32 . . . Reflector
33 . . . Back Plate
34 . . . Ion Detector
40 . . . Data Processing Unit

50 . . . Analysis Controller
51 . . . Input Unit
511 . . . Switch-Waiting Time Setter
52 . . . Voltage Controller
53 . . . First Plate Electrode Voltage Source
5 54 . . . Second Plate Electrode Voltage Source
55 . . . Third Plate Electrode Voltage Source

The invention claimed is:

1. A mass spectrometer capable of an MS/MS measurement, including a collision cell configured to dissociate an ion by collision induced dissociation, and a plurality of electrodes located at a frontward or rearward position from the collision cell and configured to be supplied with a DC offset voltage for imparting collision energy to an ion entering the collision cell, the mass spectrometer further comprising:

a) a plurality of voltage generators configured to apply voltages to the plurality of electrodes, respectively; and b) a voltage controller configured to control the plurality of voltage generators in switching a polarity of the DC offset voltage along with a switching operation between a positive ion measurement mode and a negative ion measurement mode, in such a manner that each of the voltages applied to the plurality of electrodes is temporarily changed to zero from a DC offset voltage used immediately before the switching operation, then maintained at zero for a predetermined waiting time, and subsequently changed to a DC offset voltage to be used after the switching operation.

2. The mass spectrometer according to claim 1, further comprising:

a time setter configured to allow a user to set the waiting time.

3. The mass spectrometer according to claim 2, further comprising:

a quadrupole mass filter located on a front side of the collision cell and an orthogonal acceleration time-of-flight mass analyzer on a rear side of the collision cell.

4. The mass spectrometer according to claim 1, further comprising:

a quadrupole mass filter located on a front side of the collision cell and an orthogonal acceleration time-of-flight mass analyzer on a rear side of the collision cell.

5. The mass spectrometer according to claim 1, wherein the waiting time is set to be longer than a discrepancy in timing of a switching operation of the polarity of the voltages applied to the plurality of electrodes.

6. The mass spectrometer according to claim 5, further comprising:

a quadrupole mass filter located on a front side of the collision cell and an orthogonal acceleration time-of-flight mass analyzer on a rear side of the collision cell.

* * * * *